US008505837B2

(12) United States Patent
Warchola

(10) Patent No.: US 8,505,837 B2
(45) Date of Patent: Aug. 13, 2013

(54) TAILGATE SPREADER HOPPER FILL STATUS SENSOR

(75) Inventor: Marty Warchola, Medina, OH (US)

(73) Assignee: Meyer Products, LLC, Cleveland, OH (US)

( * ) Notice: Subject to any disclaimer, the term of this patent is extended or adjusted under 35 U.S.C. 154(b) by 649 days.

(21) Appl. No.: 12/823,564

(22) Filed: Jun. 25, 2010

(65) Prior Publication Data

US 2011/0147481 A1 Jun. 23, 2011

Related U.S. Application Data

(60) Provisional application No. 61/221,656, filed on Jun. 30, 2009.

(51) Int. Cl.

| | |
|---|---|
| ***E01C 19/20*** | (2006.01) |
| ***A01C 19/02*** | (2006.01) |
| ***A01C 19/00*** | (2006.01) |

(52) U.S. Cl.

USPC ..... 239/675; 239/71; 239/72; 239/74; 239/672; 239/677; 239/681; 239/684; 239/687

(58) Field of Classification Search

USPC ..... 239/7, 71–74, 650, 660, 667–670, 239/672–683, 687–689

See application file for complete search history.

(56) References Cited

U.S. PATENT DOCUMENTS

| | | | | |
|---|---|---|---|---|
| 4,230,280 | A | 10/1980 | Leigh et al. | |
| 4,523,280 | A | 6/1985 | Bachman | |
| 4,551,663 | A | 11/1985 | Gruber | |
| 4,912,935 | A | 4/1990 | Goldstein | |
| 5,018,668 | A * | 5/1991 | Bauer | 239/655 |
| 6,089,478 | A * | 7/2000 | Truan et al. | 239/675 |
| 6,092,745 | A * | 7/2000 | Seymour et al. | 239/675 |
| 2003/0168522 | A1 * | 9/2003 | Kost et al. | 239/100 |
| 2006/0144798 | A1 | 7/2006 | Dixon et al. | |

* cited by examiner

*Primary Examiner* — Darren W Gorman

(74) *Attorney, Agent, or Firm* — Roger D. Emerson; Timothy D. Bennett; Emerson Thomson Bennett

(57) ABSTRACT

A spreader assembly may include a hopper, an auger mechanism, a torque sensor that provides a signal based on a condition of the auger mechanism and, a controller that receives the signal from the torque sensor and determines a fill status of the hopper based on the signal from the torque sensor.

20 Claims, 6 Drawing Sheets

TAILGATE SPREADER HOPPER FILL STATUS SENSOR

This application claims priority to U.S. Ser. No. 61/221,656, entitled TAILGATE SPREADER HOPPER FILL STATUS SENSOR, filed Jun. 30, 2009, which is incorporated herein by reference.

I. BACKGROUND OF THE INVENTION

A. Field of Invention

This invention pertains to the art of spreader assemblies used to spread salt and/or sand onto road surfaces, and more specifically to a tailgate spreader assembly that can sense the hopper fill status and communicate the status to the operator.

B. Description of the Related Art

Salt and/or sand spreading is a common practice to maintain roads, parking spaces, and other ground surfaces during the winter months. It is known to use larger vehicles as well as smaller vehicles, such as pickup trucks, to perform this type of service. Numerous types of salt spreaders have been developed to be attached to conventional vehicles. Typically, the spreader is attached to the rear of the vehicle to spread particulate material, such as salt, sand, cinders, etc. onto the ground surface being traveled by the vehicle. One of the more common spreaders employs a hopper having a lower discharge opening through which the particulate material falls onto a rotating spinner plate. By rotating the spinner plate as spreading material is being discharged onto the spinner plate, the particulate material is centrifugally propelled by the spinner plate in a wide pattern onto the ground surface. Typically, a motor is mounted on the spreader to cause the spinner plate to rotate. Typical spreader attachment assemblies used in conjunction with pick-up trucks fasten the spreader to the truck's rear bumper or tailgate. It is also known to include an auger mechanism with spreader assemblies to help to transfer the spreading material from the hopper to the spinner plate.

While many known spreader assemblies work well for their intended purpose, improvements are desirable. One desired improvement is related to determining the fill status of the hopper. Currently, the operator must exit the vehicle passenger compartment and visually inspect the hopper to determine if the hopper needs to be refilled with salt or sand. This is inconvenient for the operator and increases the chance that the spreader assembly will be operated without actually spreading material.

What is needed is a spreader assembly that provides an easy way for the operator to determine the fill status of the hopper.

II. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

III. DETAILED DESCRIPTION OF THE INVENTION

Figure 1:
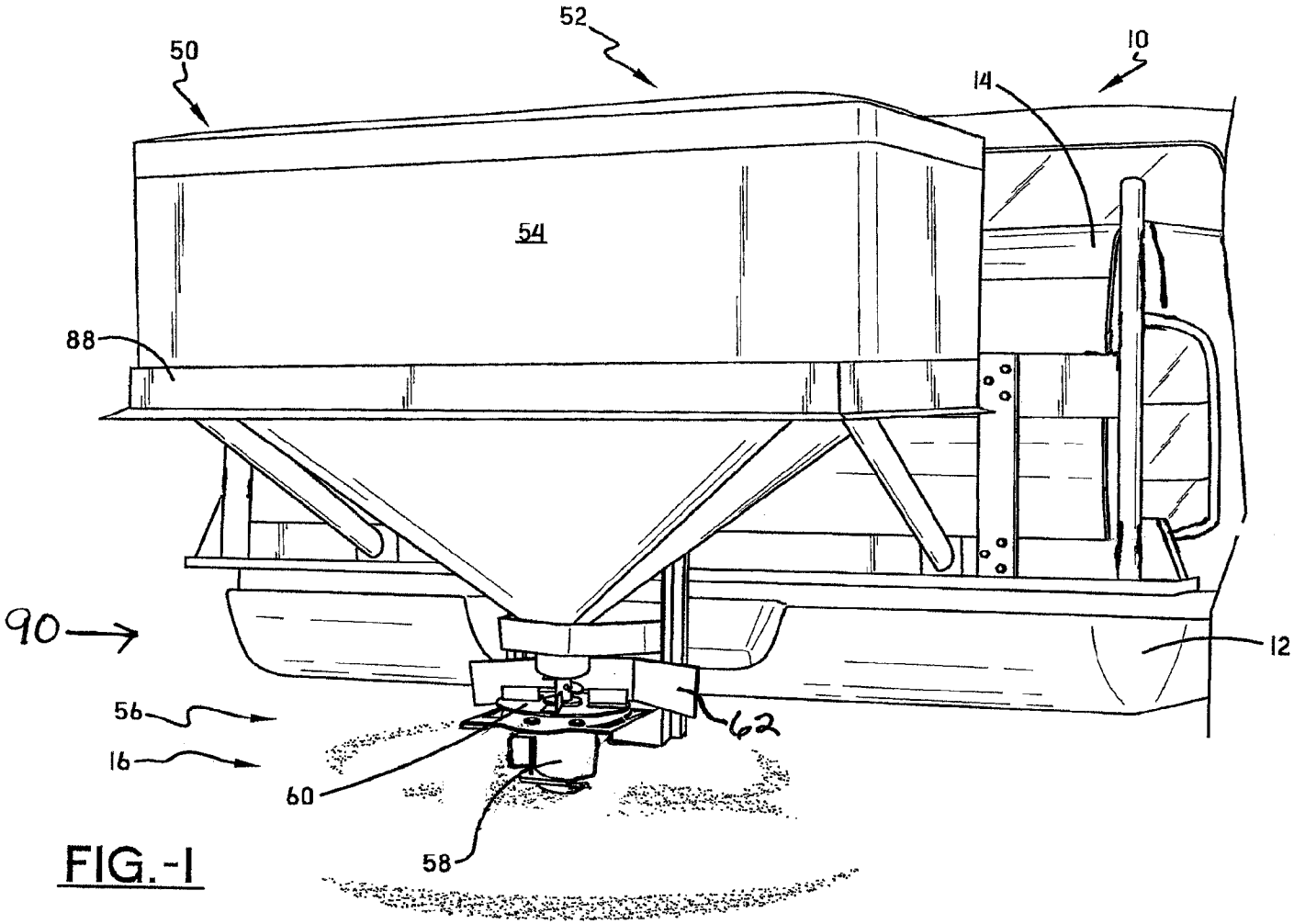
FIG. 1 is a back view of a spreader assembly shown attached to the back portion of a vehicle.

Referring now to the drawings wherein the showings are for purposes of illustrating embodiments of the invention only and not for purposes of limiting the same, FIG. 1 shows a spreader assembly 50 including an auger mechanism 90 according to one embodiment of this invention, attached to back end of a vehicle 10. While the vehicle 10 shown is commonly known as a pick-up truck it should be noted that this invention will work with any vehicle chosen with the sound judgment of a person of skill in the art. The vehicle 10 may include a bumper 12, a tailgate 14 and a hitch (not visible but well known to those of skill in the art). Because the spreader assembly 50 is attached to back end of a pick-up truck having a tailgate 14, it is commonly referred to as a tailgate spreader. However, it should be noted that this invention will work with any spreader assembly chosen with the sound judgment of a person of skill in the art.

With continuing reference to FIG. 1, the spreader assembly 50 may include a frame 52 that is attachable to the vehicle 10, a hopper 54 supported to the frame 52 for use in holding a material to be spread, a spinner mechanism 56 supported to the frame 52 that is used to spread the material held in the hopper 54 onto any appropriate ground surface 16 including roads, parking spaces, drive ways, sidewalks, and the like, and an auger mechanism 90 which helps to transfer the material from the hopper 54 to the spinner plate 60 in a known manner The frame 52 may include a hopper support member 88 to assist in supporting the hopper 54. The material held in the hopper 54 which is to be spread onto the ground surface 16 can be any appropriate for winter weather or other uses chosen with the sound judgment of a person of skill in the art. Some non-limiting examples include salt, sand, and cinders. The hopper 54 can be of any design and formed of any material chosen with the sound judgment of a person of skill in the art. In one specific embodiment, the hopper 54 is formed of polyethylene and the material held within the hopper 54 is salt.

With reference now to FIGS. 1-5, the spinner mechanism 56 can be of any design chosen with the sound judgment of a person of skill in the art. For the embodiments shown in FIGS. 2-3, the spinner mechanism 56 includes a motor 58, a shaft 59 that is rotatable by the motor 58 and a spinner plate 60 attached to the shaft 59. The motor 58 rotates shaft 59 which rotates spinner plate 60 to spread the material held in the hopper 54 onto the ground surface 16. A baffle plate 62, shown in FIG. 1, may be used to prevent the material from being propelled toward the vehicle 10. The auger mechanism 90 also can be of any type chosen with the sound judgment of a person of skill in the art. For the embodiments shown in FIGS. 2-3, the auger mechanism 90 includes an auger 92 that is generally vertically oriented along the shaft 59 and extends through a discharge opening formed in the lower portion of the hopper 54. It should be noted that the auger 92 can be oriented in any manner chosen with the sound judgment of a person of skill in the art. In another embodiment for example, shown in FIGS. 4-5, the auger 92 is positioned on a shaft that is generally horizontally oriented. To operate the auger mechanism 90 shown in FIGS. 2-3, the motor 58 rotates shaft 59 which rotates auger 92. For the embodiments shown in FIGS. 2-3, both the spinner plate 60 and the auger 92 are attached to the same shaft 59 and thus both can be operated with the same motor, motor 58. In another embodiment, shown in FIGS. 4-5, the spinner plate 60 and auger 92 are each attached to a separate shaft, 59*a* and 59*b* respectively, that is rotated by a separate motor, 58*a* and 58*b*, respectively.

Schematic diagrams of embodiments of the auger mechanism 90 are shown in FIGS. 2-5. These FIGURES show a controller 200 which may be of any type chosen with the sound judgment of a person of skill in the art and which may be used to operate the auger mechanism 90. The controller 200 also may be used for any number and type of controlling functions, including controlling the spinner mechanism 56 and/or controlling functions beyond the control of the spreader assembly 50, chosen with the sound judgment of a person of skill in the art. The controller 200 may be fixed to an inside surface of the vehicle 10, shown in FIG. 1, fixed to an outside surface of the vehicle 10, or non-fixed to any surface and thus readily movable by the operator within and/or without the vehicle 10. In one embodiment, shown, the controller 200 may require "hard wiring" to connect it to the spreader assembly 50 while in another embodiment the controller 200 may be wireless. In one embodiment, the controller 200 may be used to operate the auger mechanism 90 by controlling the power provided to the motor 58 or 58*b* to thereby control the rotation of the auger 92.

With reference now to FIGS. 2-5, the controller 200 may be electrically connected to: a battery 205 (the vehicle 10 battery in one embodiment) which is connected to ground 207; a sensor 201 which provides a signal 202 to the controller 200 based on a condition of the auger mechanism 90 (discussed further below); and, the motor 58 or 58*b* to thereby control the operation of the auger mechanism 90. As the operation and interconnection of these components, with further explanation on some components provided below, is well known to those of skill in the art, further explanation will not be provided here. However, it should be noted that multiple sensors 201 may be used if necessary.

Figure 2:
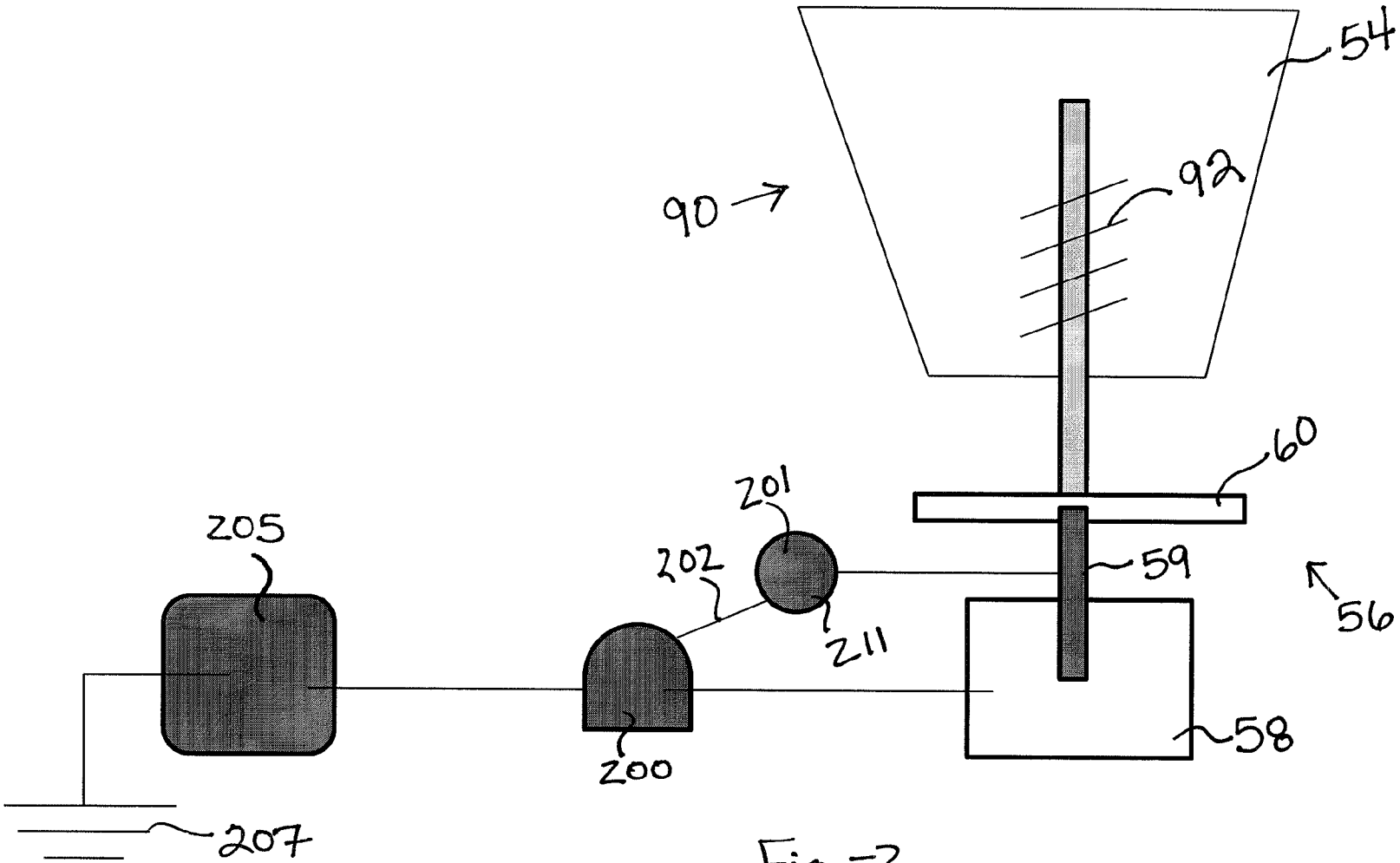
FIG. 2 is a schematic drawing of a spreader assembly according to one embodiment of this invention.
Figure 4:
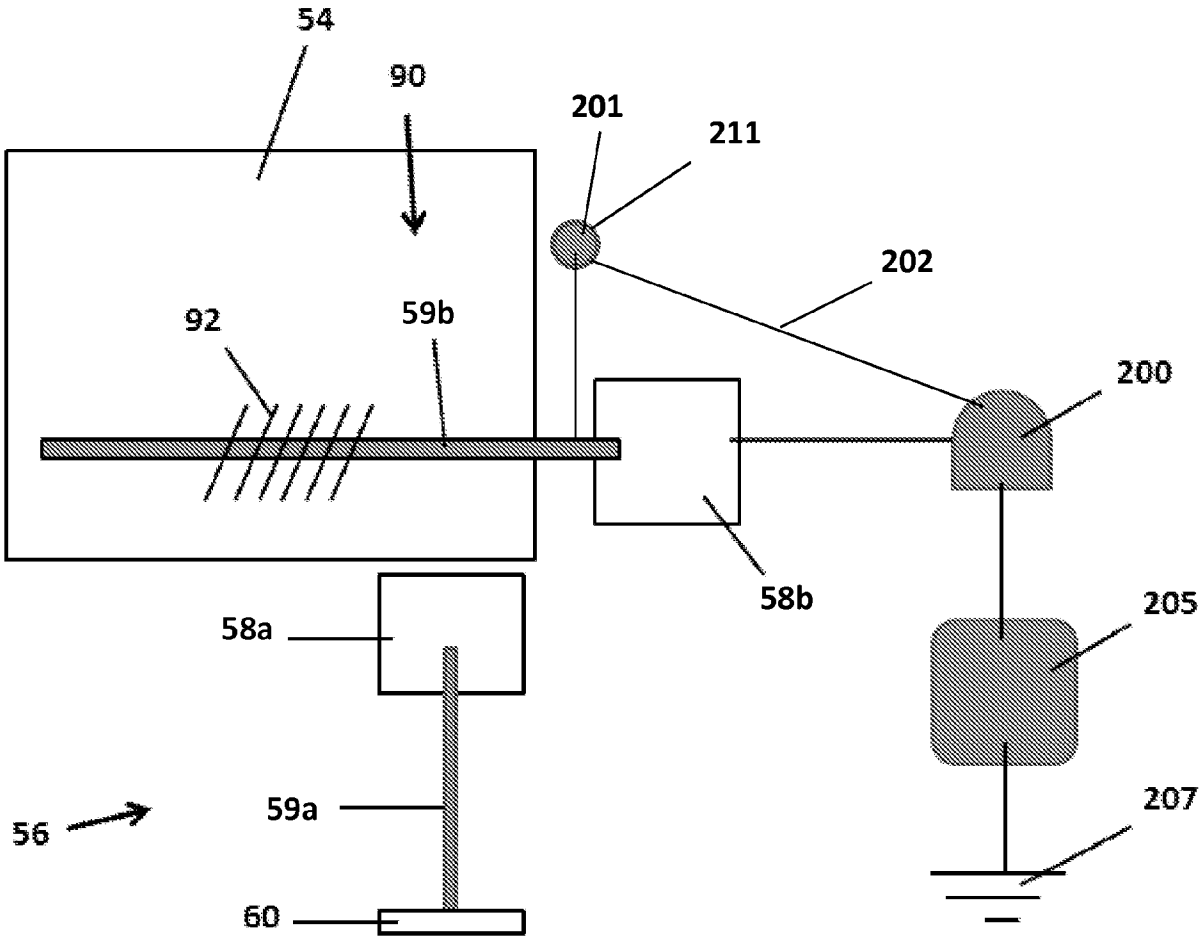
FIG. 4 is a schematic drawing of a spreader assembly according to another embodiment of this invention.

With reference to FIGS. 1, 2 and 4, in one embodiment the sensor 201 is a torque sensor 211 that detects the torque load placed on the auger shaft 59 or 59*b*. The type of torque sensor 211 used with this invention can be any chosen with the sound judgment of a person of skill in the art. As a general rule, there is a direct correlation between the fullness (fill status) of the spreading material in the hopper 54 and the torque load placed on the auger shaft 59 or 59*b*. In other words, the more spreading material in the hopper 54, the more power (expressed in terms of shaft torque in this embodiment) required to move the spreading material out of the hopper 54 and onto the spinner plate 60. As the amount of spreading material in the hopper 54 is reduced (indicating a lower fill level) the torque load placed on the auger shaft 59 or 59*b* is correspondingly reduced. Thus, when the amount of spreading material in the hopper 54 is large (indicating a "full" fill level) the torque load placed on the auger shaft 59 or 59*b* to spread the material is at a relative maximum. Similarly, when the amount of spreading material in the hopper 54 is substantially zero (indicating an "empty" fill level) the torque load placed on the auger shaft 59 or 59*b* is at a relative minimum. The specifics of the correlation between the fullness (fill status) of the spreading material in the hopper 54 and the torque load placed on the auger shaft 59 or 59*b* can be quantified for each application. This correlation data can then be inserted (programmed) into the controller 200 which can be used as discussed further below.

Figure 3:
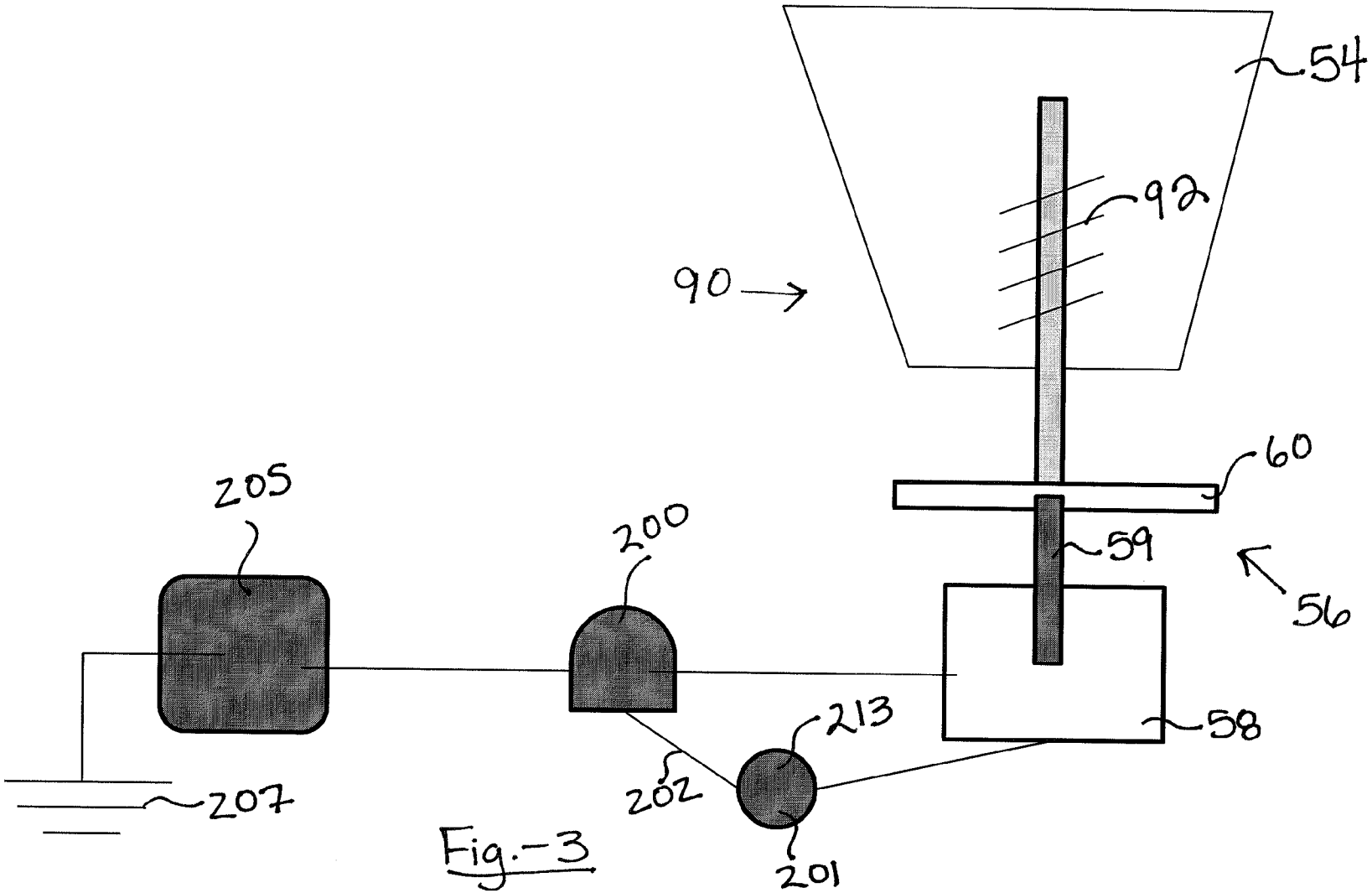
FIG. 3 is a schematic drawing of a spreader assembly according to another embodiment of this invention.
Figure 5:
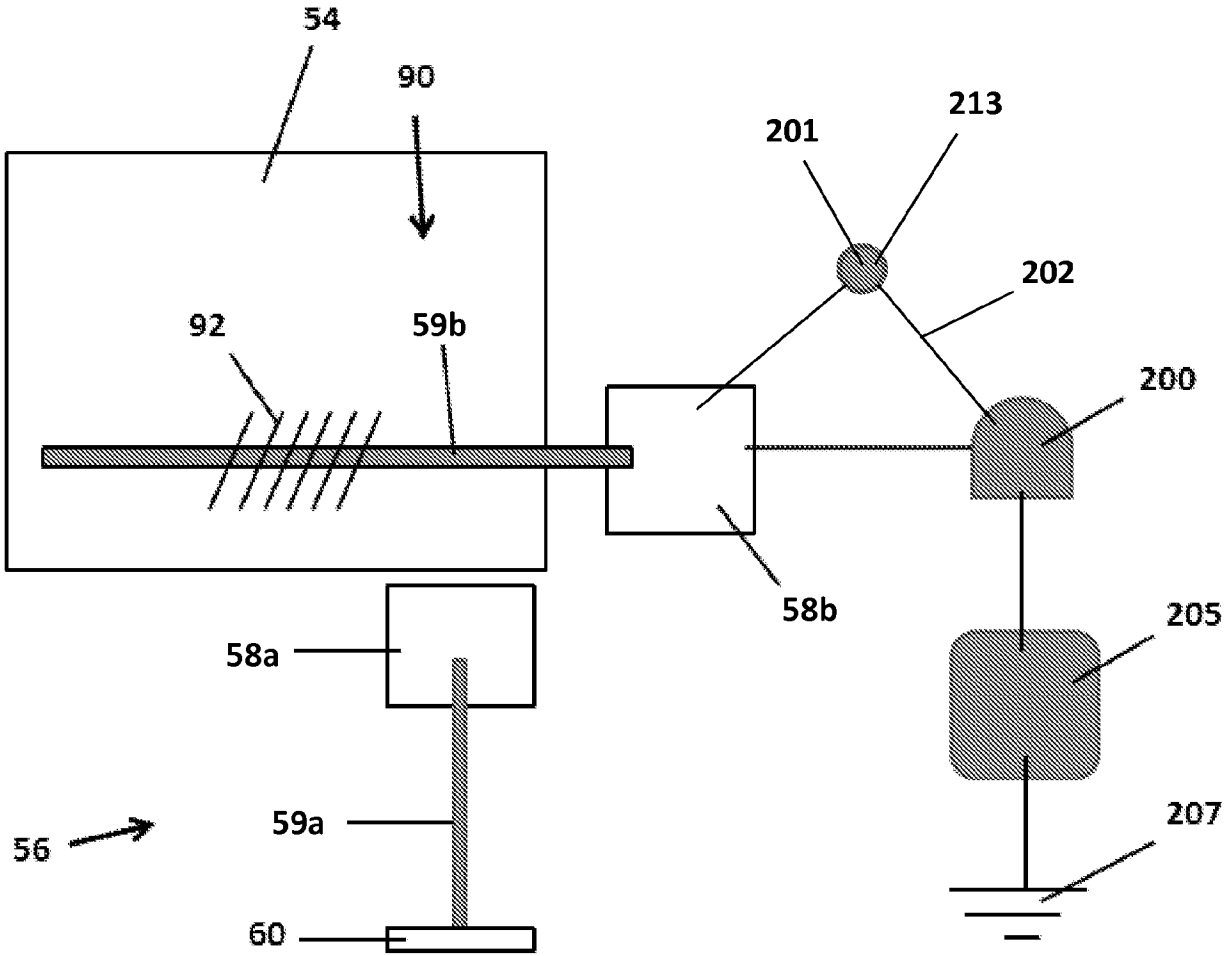
FIG. 5 is a schematic drawing of a spreader assembly according to another embodiment of this invention.

With reference now to FIGS. 1, 3 and 5, in another embodiment the sensor 201 is a current sensor 213 that detects the current draw placed on the motor 58 or 58*b*. The type of current sensor 213 used with this invention can be any chosen with the sound judgment of a person of skill in the art. As a general rule, there is a direct correlation between the fullness (fill status) of the spreading material in the hopper 54 and the current draw placed on the motor 58 or 58*b*. In other words, the more spreading material in the hopper 54, the more power (expressed in terms of current draw in this embodiment) required to move the spreading material out of the hopper 54 and onto the spinner plate 60. As the amount of spreading material in the hopper 54 is reduced (indicating a lower fill level) the current draw placed on the motor 58 or 58*b* is correspondingly reduced. Thus, when the amount of spreading material in the hopper 54 is large (indicating a "full" fill level) the current draw placed on the motor 58 or 58*b* to spread the material is at a relative maximum. Similarly, when the amount of spreading material in the hopper 54 is substantially zero (indicating an "empty" fill level) the current draw placed on the motor 58 or 58*b* is at a relative minimum. The specifics of the correlation between the fullness (fill status) of the spreading material in the hopper 54 and the current draw placed on the motor 58 or 58*b* can be quantified for each application. This correlation data can then be inserted (programmed) into the controller 200 which can be used as discussed further below.

Figure 6:
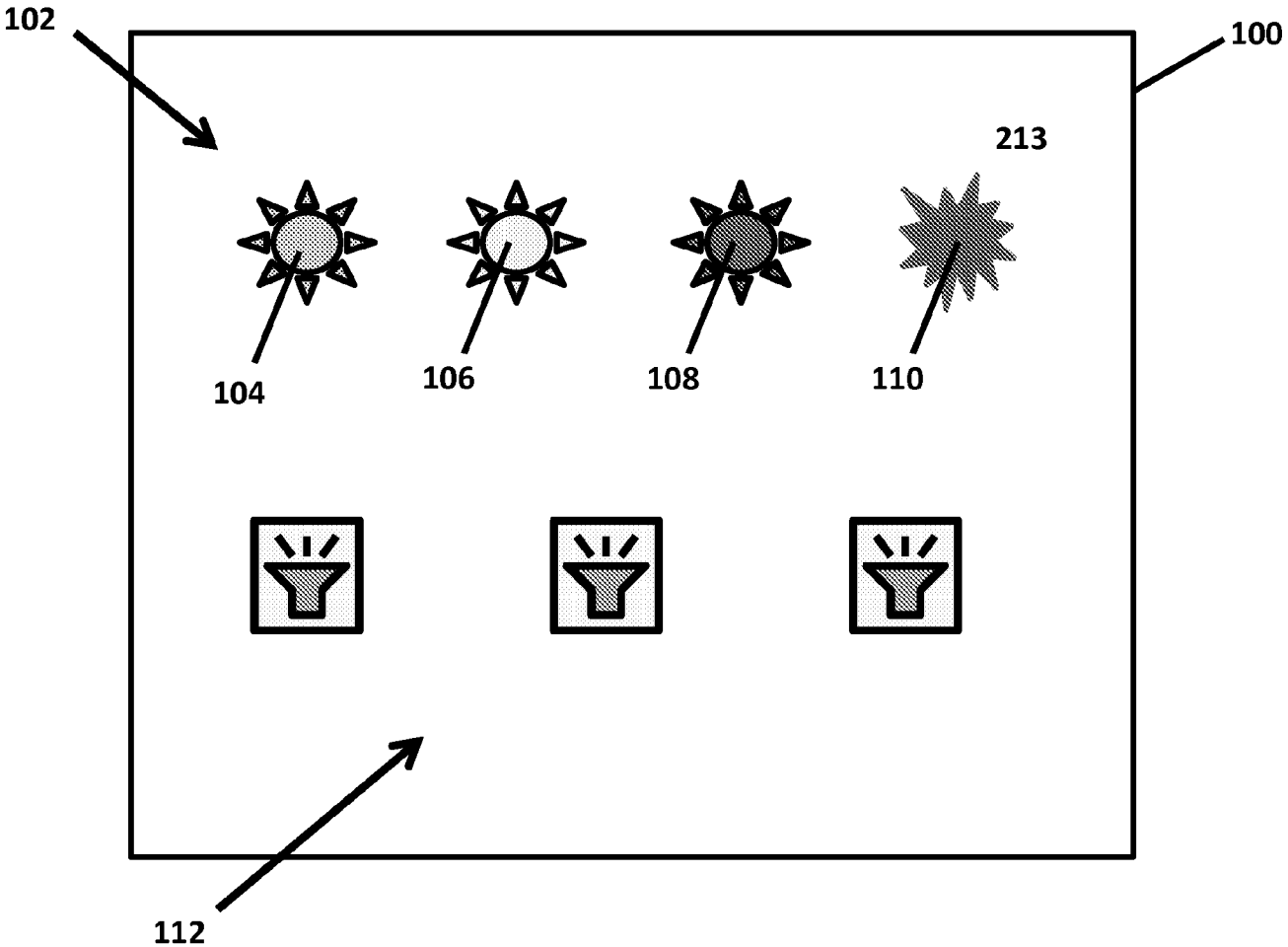
FIG. 6 is a schematic drawing of a control panel.

With reference again to FIGS. 2-6, once the controller 200 has acquired the relevant data from the sensor 201, the controller 200 can provide corresponding feedback to the operator and/or adjust the operation of the auger mechanism 90. The particular feedback and/or adjustment provided by the controller 200 can be any chosen with the sound judgment of a person of skill in the art. In one embodiment, shown in FIG. 6, a control panel 100 may be provided for the operator's view. The control panel 100 may provide, for example, light and/or audio indicators 102 and 112, respectively, that indicate the fullness of the hopper 54 based on what the sensor 201 senses. In one specific embodiment, a green light 104 may be used to indicate that the hopper 54 is at least 50% full, a yellow light 106 may be used to indicate that the hopper 54 is between 10% and 50% full, a red light 108 may be used to indicate that the hopper 54 about 10% full, and a red blinking light 110 may be used to indicate that the hopper 54 about empty. The control panel 100 may be a separate device (not shown) mounted within the vehicle passenger compartment, to the dash board, for example, or may be a screen (or portion of a screen) provided on the controller 200. In another embodiment, the controller 200 may be used to automatically adjust the operation of the auger mechanism 90 based on what the sensor 201 senses. In one specific embodiment, the controller 200 may stop or shut off power to the motor 58 or 58*b* once the sensor 201 determines that the hopper 54 is empty. In this way, operation of the auger mechanism 90 and/or the spinner mechanism 56 may be automatically stopped when the hopper 54 is empty thereby saving energy.

With reference now to FIGS. 1-6, the inventors have also discovered other possible uses of the auger mechanism 90 of this invention based on if the spreading material has become caked, wedged, jammed or otherwise stuck to (or around) the auger. If the spreading material has become stuck to the auger 92, making it more difficult to rotate the shaft 59 or 59*b*, then there is a direct correlation between the degree or amount of "stuckness" and the torque load placed on the auger shaft 59 or 59*b*. Similarly, there is a direct correlation between the degree or amount of "stuckness" and the current draw placed on the motor 58 or 58*b*. If, however, the spreading material has become stuck to an inside surface of the hopper 54, permitting the shaft 59 or 59*b* to rotate freely without contacting any spreading material, then there is an inverse correlation between the degree or amount of "stuckness" and the torque load placed on the auger shaft 59 or 59*b*. Similarly, there is in this case, an inverse correlation between the degree or amount of "stuckness" and the current draw placed on the motor 58 or 58*b*. In application, this use of the auger mechanism 90 appears to be especially useful when the torque load and/or current draw are especially large or small. If the torque load and/or current draw are especially large, for example, it may indicate that the spreading material is encased around the auger 92. The controller 200 can indicate this status, as described above, alerting the operator to check the auger mechanism 90. Similarly, if the torque load and/or current draw are especially small it may indicate that the spreading material is stuck to the hopper and not in contact with the auger 92. The controller 200 can indicate this status alerting the operator to check the auger mechanism 90.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

I claim:

1. A spreader assembly comprising:

a frame that is attachable to an associated vehicle;

a hopper supported to the frame and suitable to hold a material to be spread onto an associated ground surface;

a spinner mechanism supported to the frame and comprising: (1) a spinner plate; (2) a motor; and, (3) a shaft that is rotatable by the motor to rotate the spinner plate to spread the material onto the associated ground surface;

an auger mechanism comprising: (1) an auger; (2) a motor; and, (3) a shaft that is rotatable by the motor to rotate the auger to transfer the material from the hopper to the spinner plate;

a sensor that provides a signal based on a condition of the auger mechanism, wherein the sensor is one of: (1) a torque sensor that detects the torque load placed on the shaft that is rotatable by the motor to rotate the auger; and, (2) a current sensor that detects the current draw placed on the motor that rotates the auger; and, a controller that: (1) receives the signal from the sensor; (2) determines a fill status of the hopper based on the signal from the sensor; and, (3) operates the auger mechanism based on the fill status of the hopper.

2. The spreader assembly of claim 1 wherein the sensor is a torque sensor that detects the torque load placed on the shaft that is rotatable by the motor to rotate the auger.

3. The spreader assembly of claim 1 wherein the sensor is a current sensor that detects the current draw placed on the motor that rotates the auger.

4. The spreader assembly of claim 1 wherein the controller also operates the spinner mechanism.

5. The spreader assembly of claim 1 wherein the auger is generally vertically oriented along the shaft.

6. The spreader assembly of claim 1 wherein the auger is generally horizontally oriented along the shaft.

7. The spreader assembly of claim 1 wherein:

the controller provides feedback regarding the fill status of the hopper to a control panel; and the control panel provides at least one audio indicator that indicates the fill status of the hopper.

8. The spreader assembly of claim 1 wherein:

the controller provides feedback regarding the fill status of the hopper to a control panel; and the control panel provides at least one light indicator that indicates the fill status of the hopper.

9. The spreader assembly of claim 8 wherein the control panel provides:

a first color light indicating that the hopper is at a first fill level;

a second color light indicating that the hopper is at a second fill level; and, a third color light indicating that the hopper is at a third fill level.

10. The spreader assembly of claim 1 wherein the controller determines a stuckness status of the auger based on the signal from the sensor.

11. A spreader assembly comprising:

a frame that is attachable to an associated vehicle;

a hopper supported to the frame and suitable to hold a material to be spread onto an associated ground surface;

a motor;

a spinner mechanism comprising a spinner plate;

an auger mechanism comprising an auger;

a shaft to which the spinner plate and the auger are attached, wherein the shaft is rotatable by the motor to rotate the spinner plate to spread the material onto the associated ground surface and to rotate the auger to transfer the material from the hopper to the spinner plate;

a sensor that provides a signal based on a condition of the auger mechanism, wherein the sensor is one of: (1) a torque sensor that detects the torque load placed on the shaft; and, (2) a current sensor that detects the current draw placed on the motor; and, a controller that: (1) receives the signal from the sensor; (2) determines a fill status of the hopper based on the signal from the sensor; and, (3) operates the auger mechanism based on the fill status of the hopper.

12. The spreader assembly of claim 11 wherein the sensor is a torque sensor that detects the torque load placed on the shaft.

13. The spreader assembly of claim 11 wherein the sensor is a current sensor that detects the current draw placed on the motor.

14. The spreader assembly of claim 11 wherein the controller also operates the spinner mechanism.

15. The spreader assembly of claim 11 wherein the auger is generally vertically oriented along the shaft.

16. The spreader assembly of claim 11 wherein the auger is generally horizontally oriented along the shaft.

17. The spreader assembly of claim 11 wherein:

the controller provides feedback regarding the fill status of the hopper to a control panel; and, the control panel provides at least one audio indicator that indicates the fill status of the hopper.

18. The spreader assembly of claim 11 wherein:

the controller provides feedback regarding the fill status of the hopper to a control panel; and, the control panel provides at least one light indicator that indicates the fill status of the hopper.

19. The spreader assembly of claim 18 wherein the control panel provides:

a first color light indicating that the hopper is at a first fill level;

a second color light indicating that the hopper is at a second fill level; and, a third color light indicating that the hopper is at a third fill level.

20. The spreader assembly of claim 11 wherein the controller determines a stuckness status of the auger based on the signal from the sensor.

* * * * *